US005535979A

United States Patent [19]

Ellis-Callow

[11] Patent Number: 5,535,979

[45] Date of Patent: Jul. 16, 1996

[54] APPARATUS FOR USE IN FORMING RECESSES IN CAST BODIES

[75] Inventor: Trevor J. Ellis-Callow, Bishops Stortford, England

[73] Assignee: Conac Limited, Essex, England

[21] Appl. No.: 239,383

[22] Filed: May 6, 1994

[30] Foreign Application Priority Data

May 10, 1993 [GB] United Kingdom ..... 9309594

[51] Int. Cl.[6] ..... B28B 1/44; B28B 7/16; B28B 23/00

[52] U.S. Cl. ..... 249/94; 249/97; 249/142; 249/175; 249/183

[58] Field of Search ..... 249/63, 96, 97, 249/142, 183, 175, 91, 93, 94

[56] References Cited

U.S. PATENT DOCUMENTS

| | | | |
|---|---|---|---|
| 1,552,246 | 9/1925 | Thompson | 249/95 |
| 4,053,134 | 10/1977 | Peacock | 249/94 |
| 4,173,856 | 11/1979 | Fricker . | |
| 4,296,909 | 10/1981 | Haeussler | 249/94 |
| 4,383,674 | 5/1983 | Fricker . | |
| 4,383,675 | 5/1983 | Fricker . | |
| 4,726,562 | 2/1988 | Courtois et al. | 249/94 |
| 4,821,994 | 4/1989 | Fricker . | |
| 5,061,165 | 10/1991 | Guzikowski | 249/97 |
| 5,155,954 | 10/1992 | Roire . | |

FOREIGN PATENT DOCUMENTS

| | | |
|---|---|---|
| 0049456 | 4/1982 | European Pat. Off. . |
| 0049455 | 4/1984 | European Pat. Off. . |
| 0118865 | 9/1984 | European Pat. Off. . |
| 0498742 | 8/1992 | European Pat. Off. . |
| 1969031 | 6/1967 | Germany . |
| 2446419 | 9/1974 | Germany . |
| 0787698 | 9/1955 | United Kingdom . |
| 1595533 | 1/1978 | United Kingdom . |
| 2129029 | 5/1984 | United Kingdom . |
| 9117031 | 11/1991 | WIPO . |

*Primary Examiner*—Khanh P. Nguyen
*Attorney, Agent, or Firm*—Cushman, Darby & Cushman

[57] ABSTRACT

The invention provides apparatus for use in connection with the casting of bodies, e.g. of concrete panels, which are to contain within them one or more anchor members which extend towards the surface of the body and are accessible within recesses formed in said surface. The releasible attachment of a recess former to an anchor to form an assembly for use in the casting of a body in which body the anchor is to be secured during casting and from which body the recess former is to be removed after casting to leave a cast recess containing a portion of the anchor is provided in which a connector member is applied to the said portion of the anchor to engage at least one formation provided on said anchor, the connector member and the said portion of the anchor are placed into a cavity in the recess former, and the connector member is releasably secured in the cavity, the arrangement being such that the walls of the cavity bear on the connector member to prevent the disengagement thereof from the said formations on the anchor while the connector member is in the cavity in the recess former.

5 Claims, 2 Drawing Sheets

FIG. 1.
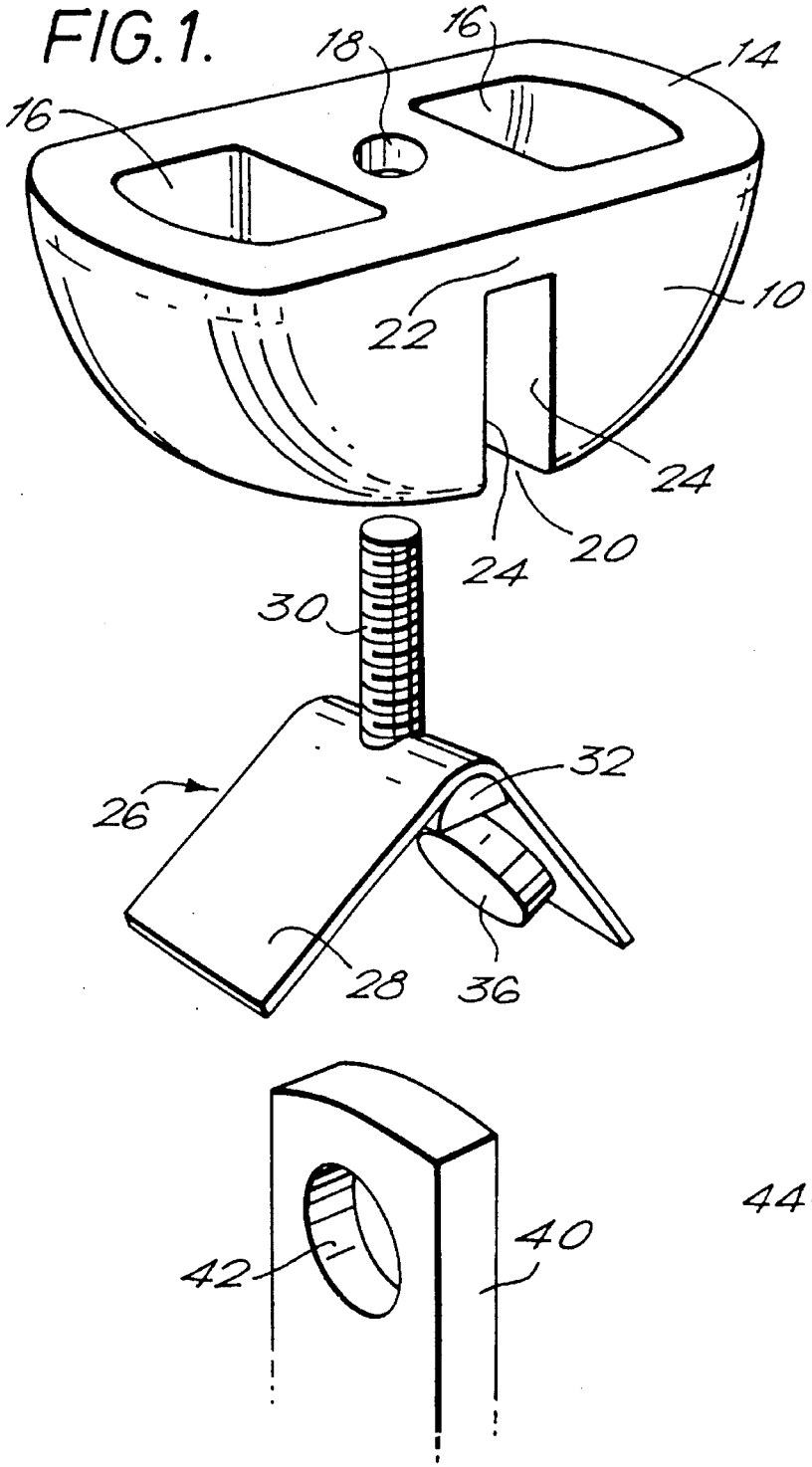
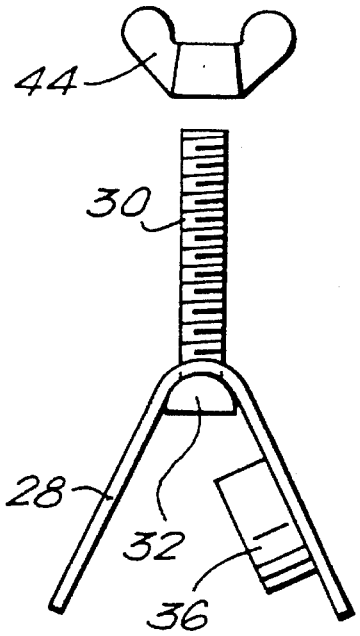
FIG. 2.

APPARATUS FOR USE IN FORMING RECESSES IN CAST BODIES

BACKGROUND OF THE INVENTION

The present invention relates to methods and apparatus for use in connection with the casting of bodies, e.g. of concrete panels, which are to contain within them one or more anchor members which extend towards the surface of the body and are accessible within recesses formed in said surface.

DESCRIPTION OF THE RELATED ART

Cast concrete panels and cast panels of like materials are used in building works. To assist in the lifting and transporting of such panels they are conventionally provided with lifting points to which a crane hook may be attached. For this purpose, anchors may be permanently embedded in the panels extending towards surfaces of the panels at which ends of the anchors are exposed within recesses formed in those surfaces. The anchors are embedded in the panels at the time the panels are cast. For this purpose, one end of the anchor is secured in a recess former and the recess former is attached to form work used in casting the panel. After the panel has been cast and the form work removed, the recess former is in turn removed leaving a recess in the surface of the panel at which an end of the anchor is accessible. Generally the anchor end will have a hole through it to which a crane hook can be attached by a suitable lifting device.

Lifting arrangements of this general type are described in Specification GB-A-1595533 and recess formers for these purposes are described in EP-A-0049455 and EP-A-0049456.

The recess formers described in EP-A-0049455 and '456 are relatively complex structures. They comprise an elastomeric cover cast over rigid core parts connected by part of the elastomeric shell so that they may be hinged with respect to one another. The recess former has a roughly half-circular shape with a radially extending through slot in its curved face into which the end of an anchor may be received. A pair of plug element protrude from the walls of the slot toward one another within the slot and these engage in the through hole in the top of the anchor to fasten the recess former to the anchor. After the panel has been cast, the recess former is levered off the anchor by flexing at the hinge referred to above. In practice it is found that the action of prising off the recess former causes damage and the former has to be replaced after approximately twenty uses on average due to excessive wear. Because of its relatively complex structure, the recess former is relatively expensive to produce and considerable waste is involved in large numbers of these recess formers having to be discarded.

It would desirable to design a form of recess former which is less susceptible to damage during removal from the anchor after the panel is cast and which is capable of being produced at a lesser cost so that it becomes less important if the recess former is damaged.

SUMMARY OF THE INVENTION

The present invention accordingly provides a method of releasably attaching the recess former to an anchor to form an assembly for use in the casting of a body in which body the anchor is to be secured during casting and from which body the recess body is to be removed after casting to leave a cast recess containing a portion of the anchor, which method comprises applying a connector member to said portion of the anchor to engage at least one formation provided on said anchor, placing the connector member and said portion of the anchor into a cavity in said recess former, and releasably securing said connector member in said cavity, the arrangement being such that the walls of the cavity bear on the connector member to prevent the disengagement thereof from the said formations on the anchor whilst the connector member is in said cavity in the recess former.

The invention also includes an assembly for use in the casting of a body in which body an anchor bearing a recess former is secured during casting and from which body the recess former is to be removed after casting to leave a cast recess containing a portion of the anchor, said assembly comprising a said recess former having a cavity therein, a said anchor having a said portion for protruding in use from a body into which the anchor is to be cast, said portion of the anchor being provided with at least one engagement formation, a connector member engaging said formation or formations provided on said anchor, said connector member and said portion of the anchor being received in said cavity of the recess former, and means releasably retaining said connector member in said cavity, wherein the walls of the cavity bear on the connector member to prevent the disengagement thereof from the said formations on the anchor whilst said connector member is in said cavity.

The invention further includes a method of casting a body in which an anchor is secured having a portion protruding from the body within a recess cast in a surface of the body, which method comprises forming an assembly as described above, attaching said assembly to form work for the casting of said body, casting said body, releasing said connector member from the recess former and withdrawing said recess former to free said connector member and anchor portion from said cavity, and removing said connector member from said anchor.

For use in the methods and assembly described above, the connector member may comprise a strap portion folded about a mid-region thereof over an end of said anchor and having at least one engagement formation thereof for engagement with said engagement formation or formations of the anchor.

The connector member may further comprise a mounting leg extending from said strap mid-portion which is passed through a through hole in the said recess former communicating with said cavity therein.

Said mounting leg may be externally threaded e.g. may be a threaded rod, and a nut may be received thereon to secure the connector member in position in said cavity. Suitably, the nut bears directly or indirectly against a face of the recess former opposite to the face thereof in which said cavity is formed.

Preferably, the anchor has a through hole therein as a said engagement formation and said strap portion of the connector member has one or more plug elements thereon as engagement formations which enter into said through hole in the anchor.

The recess former may be a generally half circular member having a radially extending slot forming said cavity.

The invention includes a connector member for use in connecting an anchor to a recess former to produce an assembly for use in a method as described above, which connector member comprises a strap portion which is foldable about a mid-region thereof, and a mounting leg extending transversely from said mid-region, wherein said strap portion is provided with one or more protrusions and/or recesses for engaging an end portion of an anchor in use. The mounting leg may be provided with a head received within the bight of the strap portion when folded and said mounting leg may extend from said head through an aperture in said strap portion. The mounting leg and its head may be removable from the strap portion. The invention includes a mounting leg and a strap portion adapted for assembly to produce such a connector member.

BRIEF DESCRIPTION OF THE DRAWINGS

The invention will be further described and illustrated with reference to the accompanying drawings in which:

FIG. 1 shows the separated components of an assembly according to the invention;

FIG. 2 shows a connector member of such an assembly in front elevation;

DETAILED DESCRIPTION OF THE PRESENTLY PREFERRED EXEMPLARY EMBODIMENT

Figure 3:
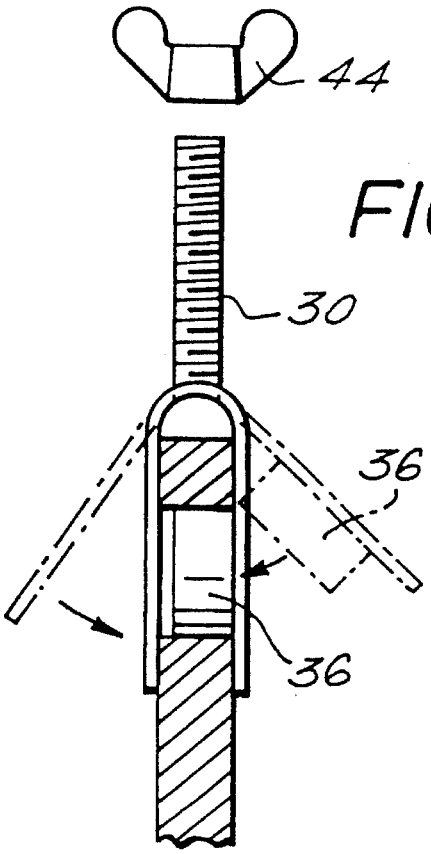
FIG. 3 shows the connector member of FIG. 2 receiving the top of an anchor.

As shown in FIG. 1, an assembly FIG. 1, an assembly according to the invention comprises a recess former 10 of rigid or elastomeric material such as plastics or natural or synthetic rubber. The recess former 10 has an approximately half circular periphery 12 (FIG. 4) and a substantially flat mounting surface 14. For improved flexibility and saving of material, cavities 16 are formed in the recess former opening on the mounting surface 14. A through hole 18 extends from the mounting surface radially through the recess former and opens into a slot 20 which extends radially inwards from the centre of the curved surface 12 and approaches the mounting surface 16 dividing the recess former into two halves joined by a flexible bridge portion 22. The slot has opposed walls 24 lying parallel to one another.

The assembly further includes a connector member 26 comprising a strap portion 28 suitably formed from flexible metal strip or plastics strip. A mounting leg 30 extends upwardly from the mid-region of the strap portion 28 and is constituted by a threaded rod of a diameter suitable to pass through the hole 18 in the recess former. A plug element 36 is provided on the strap portion 28 to one side of the mounting leg 30 and on the face of the strap portion opposite to the mounting leg 30. Optionally, there may be a second similar plug element 36 provided on the strap portion 28 on the other side of the mounting leg 30 so that the two plug elements 36 come face to face when the strap portion is flexed about its mid-region. The mounting leg 30 extends from an elongate head element 32 and is passed through a hole in the centre of the strap portion 28 so that the elongate head 32 lies across the mid-region of the strap portion which is then folded thereover.

Lastly, the assembly includes an anchor 40 having toward one end thereof a through hole 42.

Figure 4:
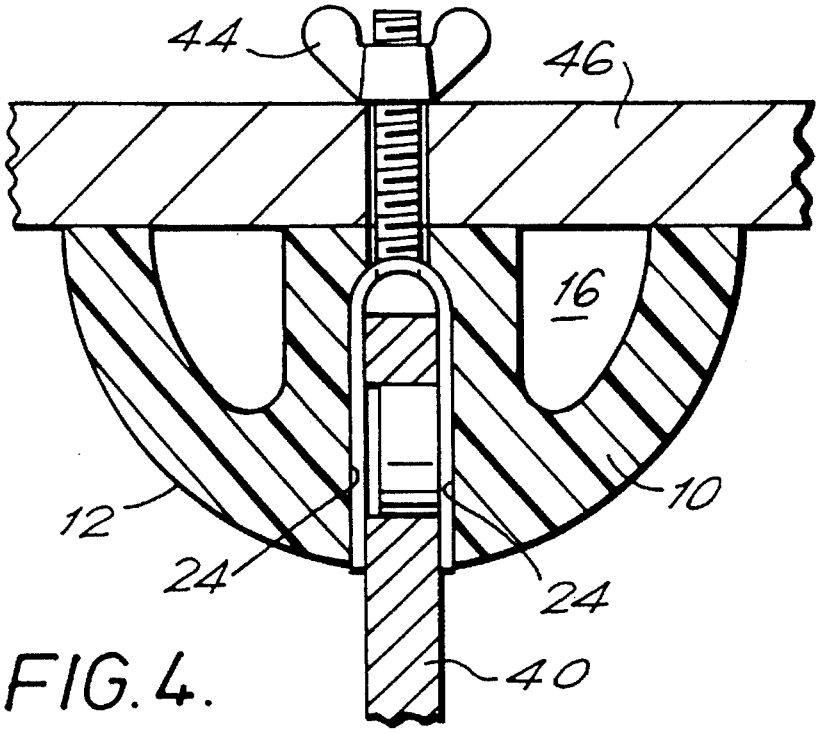
FIG. 4 shows the completed assembly.

In use, as shown in FIG. 3, the anchor is introduced into the bight of the folded strap portion 28 which is folded by the user still further to bring the plug element 36 within the through hole 42 of the anchor. The mounting leg 30 is then passed up through the cavity 20 and the through hole 18 of the recess former to protrude therethrough as shown in FIG. 4. The walls 24 of the slot (cavity) 20 hold the connector member strap portion 28 folded about the anchor. The protruding portion of the mounting leg 30 is then passed through a hole in form work 46 and a wing nut 44 is screwed down the mounting leg 30 to hold the recess former to the form work with the anchor 40 captive therein. After the panel has been cast, the apparatus may be disassembled by removal of the wing nut 44 and the lifting away of the form work. The recess former 10 may then be removed easily from the anchor and its attached connector member and thereafter the connector member is free to be removed by unfolding the strap portion 28 partially. As compared with the type of recess former described in EP-A-0049455, the need for flexing of the recess former during removal is substantially avoided so that the risk of damage to the recess former is much decreased. The complexity of the recess former is decreased as the mounting leg 30 serves the dual purpose of mounting the recess former to the form work and retaining the connector member in the recess former. The strap portion of the connector member which is flexed in use can be produced very cheaply and can be replaced readily without the remainder of the recess former apparatus needing to be replaced.

Many modifications and variations are possible within the general scope of the invention.

I claim:

1. An assembly for use in the casting of a body in which body an anchor bearing a recess former is secured during casting and from which body the recess former is to be removed after casting to leave a cast recess containing a portion of the anchor, said assembly comprising:

a said recess former having a cavity therein, a said anchor having a said portion for protruding in use from a body into which the anchor is to be cast, said portion of the anchor being provided with at least one engagement formation, a connector member engaging said at least one formation provided on said anchor, said connector member and said portion of the anchor being received in said cavity of the recess former, and means releasably retaining said connector member in said cavity, wherein the cavity has walls which bear on the connector member to prevent the disengagement thereof from said at least one formation on the anchor while said connector member is in said cavity.

2. An assembly as claimed in claim 1, wherein said connector member comprises a strap portion folded about a mid region thereof over an end of said anchor and having at least one engagement formation thereon in engagement with said engagement formation or formations of the anchor.

3. An assembly as claimed in claim 2, wherein the connector member further comprises a mounting leg extending from said strap mid portion and wherein said recess former has a through hole therein communicating with said cavity therein, said mounting leg passing from said cavity through said hole in the recess former and being secured therein.

4. An assembly as claimed in claim 3, wherein said mounting leg is externally threaded and a nut is received thereon to secure the connector member in position in said cavity.

5. An assembly as claimed in claim 2, wherein said anchor has a through hole therein as a said engagement formation and said strap portion of the connector member has one or more plug elements thereon as engagement formations which enter into said through hole in the anchor.

* * * * *